US011008768B2

(12) United States Patent
Chican

(10) Patent No.: US 11,008,768 B2
(45) Date of Patent: May 18, 2021

(54) AUDITORIUM

(71) Applicant: Pierre Chican, L'Isle-Adam (FR)

(72) Inventor: Pierre Chican, L'Isle-Adam (FR)

(73) Assignee: Oma Cinéma, L'Lsle-Adam (FR)

( * ) Notice: Subject to any disclaimer, the term of this patent is extended or adjusted under 35 U.S.C. 154(b) by 0 days.

(21) Appl. No.: 16/470,851

(22) PCT Filed: Dec. 13, 2017

(86) PCT No.: PCT/FR2017/053556

§ 371 (c)(1),
(2) Date: Jun. 18, 2019

(87) PCT Pub. No.: WO2018/115642

PCT Pub. Date: Jun. 28, 2018

(65) Prior Publication Data

US 2019/0323248 A1 Oct. 24, 2019

(30) Foreign Application Priority Data

Dec. 19, 2016 (EP) ..... 16306733
Feb. 15, 2017 (WO) ..... PCT/EP2017/053432

(51) Int. Cl.
*E04H 3/30* (2006.01)
*A63J 25/00* (2009.01)
*A47C 1/12* (2006.01)

(52) U.S. Cl.
CPC ..... *E04H 3/30* (2013.01); *A63J 25/00* (2013.01); *A47C 1/12* (2013.01)

(58) Field of Classification Search
CPC ... E04H 3/30; E04H 3/22; A63J 25/00; A47C 1/12
USPC ..... 52/6–10
See application file for complete search history.

(56) References Cited

U.S. PATENT DOCUMENTS 663,950 A * 12/1900 Williams ..... E04H 3/12 52/8
1,397,064 A * 11/1921 Togersen ..... E04H 3/22 52/8
4,879,849 A 11/1989 Hollingsworth, III et al.
5,469,669 A * 11/1995 Alter ..... E04H 3/22 52/6

(Continued)

FOREIGN PATENT DOCUMENTS

CN 1 150 207 A 5/1997
CN 1150207 5/1997

(Continued)

OTHER PUBLICATIONS https://www.visithoustontexas.com/theater/venues/wortham-center/seating-charts/.*

(Continued)

*Primary Examiner* — Brian E Glessner
*Assistant Examiner* — Adam G Barlow
(74) *Attorney, Agent, or Firm* — Fay Sharpe LLP

(57) ABSTRACT

A theater including at least one screen at a front end; a display apparatus suitable for displaying a visual content on the screen(s); and a back wall arranged facing the screen(s). The theater further includes a certain number of platforms having seats fastened on each of them, with each of the platforms being a projecting platform, presenting a width that is less than 70% of the width of the theater.

26 Claims, 15 Drawing Sheets

(56) References Cited

U.S. PATENT DOCUMENTS

| | | | | |
|---|---|---|---|---|
| 7,911,580 | B2 * | 3/2011 | Read | G03B 21/565 352/3 |
| 9,797,150 | B1 * | 10/2017 | Warren | E04H 3/22 |
| 10,513,861 | B2 * | 12/2019 | Ager | E04H 3/30 |
| 2003/0131537 | A1 * | 7/2003 | Krikorian | E04H 3/22 52/6 |
| 2014/0259967 | A1 * | 9/2014 | Ferguson | A47C 1/121 52/9 |
| 2015/0121771 | A1 * | 5/2015 | Koch | B66D 1/60 52/10 |
| 2015/0240506 | A1 * | 8/2015 | Ruhmann | E04H 3/30 52/8 |
| 2016/0333597 | A1 * | 11/2016 | de Lespinois | A63J 25/00 |

FOREIGN PATENT DOCUMENTS

| | | | |
|---|---|---|---|
| CN | 201187161 | | 1/2009 |
| CN | 203961352 | | 11/2014 |
| DE | 3317414 | A1 | 11/1984 |
| WO | WO 2012/007930 | A2 | 1/2012 |

OTHER PUBLICATIONS https://res.cloudinary.com/simpleview/image/upload/v1537192232/clients/houston/brown_seating_foundersboxes_ca1574e5-08fd-44ad-814c-5e3b9580bcbe.pdf.* https://en.wikipedia.org/wiki/Wortham_Theater_Center.*

International Search Report dated Feb. 22, 2018 for PCT/FR2017/053556.

Written Opinion dated Feb. 22, 2018 for PCT/FR2017/053556.

International Search Report for PCT/EP2017/053432 dated Sep. 6, 2017.

Written Opinion for PCT/EP 2017/053432 dated Sep. 6, 2017.

China First Office Action and translation, dated Jun. 4, 2020, for Application No. 201780086053.1. 10 pages.

* cited by examiner

EXISTING

EXISTING

AUDITORIUM

PRIORITY

This application claims priority from PCT Patent Application No. PCT/FR2017/053556, filed on Dec. 13, 2017, which claims priority to EP Patent Application No. 16306733.3, filed on Dec. 19, 2016, and EP Patent Application No. PCT/EP2017/053432, filed on Feb. 15, 2017, and are incorporated herein by reference in their entirety.

BACKGROUND OF THE DISCLOSURE

The invention lies in the field of theaters, in particular those including apparatus for displaying visual content on one or more screens, in particular apparatus for projecting visual content. Such theaters include in particular movie theaters and in particular wide screen movie theaters.

The apparatus for displaying visual content on a screen may be apparatus for projecting visual content serving to project visual content onto one or more screens, i.e. movie projection apparatus. Nevertheless, the apparatus for displaying visual content on a screen may equally well be constituted by an "active" display, i.e. a device suitable for displaying visual content on one or more visible faces, forming one or more display screens.

A known theater is described in particular in Document US 2014/0259967.

The term "screen" is used herein to designate a surface that may be plane, concave, or convex, and that is configured to enable a visual content to be displayed. Usually, the surface is substantially plane; it may also be concave in shape in horizontal section and plane in shape in vertical section. It may also be hemispherical in shape.

In order to increase the visual impact of a movie projection and increase the immersion of spectators in the image, the size of projection screens has increased significantly over the last few years. A new film format, and then a new image format, have in particular been developed, known under the name IMAX®, short for image maximum. That technology serves to project images of large dimensions with better resolution. A standard IMAX® screen measures about 25 meters (m) in width for a height of 15 m, and it is intended to increase the immersion of spectators in the image.

In order to accommodate this new relationship with the image, the arrangement of spectators facing the screen also needs to be adapted. In particular, regardless of the row in which a spectator is situated, it is important for each spectator to be able to view the full height of the projecting image without having to tilt the head excessively.

The arrangement of spectators comes within the ambit of dimensional characteristics for a theater as determined in compliance with technical and architectural criteria. In France, these criteria are governed by the AFNOR NF-S 27001 standard, itself drawn up in compliance with the CST-RT-035 recommendations of the Commission Supérieure Technique de I'Image et du Son (CST) [French image and sound superior technical commission].

Reference is made to FIGS. 1 and 2, which are section views of two existing IMAX® movie theaters, namely the IMAX®-Pathé Disney Village theater dating from 2000 in FIG. 1, and the IMAX®-Pathé-La Valette du Var theater dating from 2016 for FIG. 2.

The volume of a movie theater 1, 1*a* is determined in width to be able to contain the width of the screen 2, in height to be able to contain the height of the screen 2, and in length from the screen 2 to the back wall 3 where a projection booth 4 is arranged at a distance D from the screen. The zone for receiving tiers 5 of seats extends over a portion of the length of the theater 1, 1*a*. Reference is made to the greatest width L and the greatest height H of the projected image in order to define the characteristics for installing the tiers 5 as set out in the CST recommendations. In the description below, it is considered that the dimensions L, H of the largest projected image correspond to the dimensions L, H of the sheet constituting the screen.

With reference to FIGS. 1 and 2, the tiers 5 are arranged continuously, being made up of a succession of rows of seats, each row being accessible via one or more staircase aisles (not shown in the figures) having respective landings for serving each of the rows.

The tiers 5 extend along the projection axis XX', which is taken perpendicularly relative to the screen 2 (this projection axis XX' is parallel to the longitudinal axis of the theater, not shown), going from a first row 6 that is the lowest and the closest to the screen 2, up to a last row 7 that is the highest and the furthest away from the screen 2. The first row 6 is situated at a distance D1 from the screen and the last row 7 is situated at a distance D2 from the screen 2, where D2 is naturally greater than D1. Consideration is also given to a depth of seating D3 that extends along an axis XX' 1 parallel to the projection axis XX' from the first row 6 to the last row 7, and to a height of seating H3, which is the height equal to the difference in altitude between the first row 6 and the last row 7. Finally, consideration is given to the slope of the tiers, which is defined by the angle $\alpha$ formed between the plane P containing the eyes of the spectators in the first and last rows 6 and 7 and an axis XX' 1 parallel to the projection axis XX'.

Given the configuration of those two theaters, the spectators in the first row 6 need to tilt the head excessively in order to be able to see the entire projected image. This tilting is characterized by two angles. Starting from the eye of a spectator sitting in the first row 6, the first angle $\alpha$1 is taken between an axis XX' 1 parallel to the longitudinal axis XX' and perpendicular to the screen 2, and a straight line pointing to the half-height H/2 of the largest projected image, marked herein by the center O of the screen 2. The second angle $\alpha$2 is taken between the longitudinal axis XX' and a straight line aiming at the top edge of the largest projected image, marked herein by the top edge 8 of the screen 2. The CST recommends that the angle $\alpha$1 should be less than or equal to 30° and the angle $\alpha$2 should be less than or equal to 45°.

For the theater in FIG. 1, the first angle $\alpha$1 is 25° and the second angle $\alpha$2 is 50°, which therefore does not comply with the recommendations of the CST. For the theater in FIG. 2, the first angle $\alpha$1 is 33° and the second angle $\alpha$2 is 54°. Neither of those angles complies with the recommendations of the CST.

It can thus be seen that in both of the theaters of FIGS. 1 and 2, if the screen 2 and the projected image present large dimensions, then there is a real disparity in the quality of viewing between spectators in the first row and those in higher rows. Given the various standards and recommendations, it is not possible, at present, in such theaters to move the first row 6 away from the screen without reducing the number of rows and thus the number of seats and/or deteriorating the immersion of spectators in the last rows.

SUMMARY OF THE DISCLOSURE

The invention seeks in particular to provide a movie theater that complies with the AFNOR NF-S 27001 standard drawn up in compliance with the CST-RT-035 recommendations of the CST so as to enable all spectators, from the first row to the last to be immersed in the projected image in a manner that is improved compared with present conventional theaters, and to be able to do so without excessively tilting the head.

The invention also seeks to provide a movie theater in which the vertical geometrical distortion of the images is practically zero.

The invention also seeks to provide a movie theater that gives spectators the combined sensations of privacy and of conviviality.

Finally, the invention seeks to provide a movie theater making it possible to offer personalized services.

In a first aspect, the invention provides a theater, in particular a movie theater, having a projection screen configured to enable an image that is defined by its greatest width and by its greatest height to be projected along a projection axis that is perpendicular to said screen. Facing the screen there extends a back wall situated at a certain distance from the screen, in which there is installed a projection booth housing movie projection apparatus. The theater includes a zone receiving tiers of seats extending from a first row situated at a first distance closest to the screen to a last row situated at a second distance furthest from the screen, thereby defining a seating height between the first and last rows and a slope for the seating zone that is defined by the angle formed between the plane containing the first and last rows of the tiers and an axis perpendicular to the screen.

In a first aspect, the movie theater of the invention is characterized essentially in that the seating zone comprises a plurality of suspended platforms forming discontinuous tiers along at least a portion of the height of the screen and each including at least one row of seats, and in that the angle a defining the slope of the seating zone is greater than 24°.

Advantageously, the theater enables the number of spectators in the theater to be maximized, for given ground area. This configuration thus makes it easier to install movie theaters in dense built-up areas.

The term "platform" is used to designate a structure having a top surface generally arranged at a given level (or storey) of the theater, and that enables spectators to walk on the platform and access seats that are provided on the platform. The top surface of the platform may be horizontal or sloping; if sloping, it normally slopes towards the screen. The top surface of the platform may include steps.

The movie theater of the invention may also include the following optional characteristics, considered in isolation or in any other technically feasible combination:

The angle $\alpha$ defining the slope of the seating zone is greater than 30°, preferably greater than 40°.

The first row of seats in the lowest platform(s) is situated at a distance D1, D1*a* closest to the screen satisfying the following criteria:

$$D1 \geq 0.6 \times L$$

where L is the width of the largest image projected on the screen.

The last row of the lowest platform(s) is situated at a second distance D2 furthest from the screen that, together with the seating height H3 of the seating zone formed in this way, satisfies the following criteria:

$$D2 < 1.5 \times L \text{ and } H3 > 0.6 \times H$$

where L is the width of the largest image projected on the screen; and where H is the height of the largest image projected on the screen.

The seating height H3 and the second distance D2 satisfy the following criteria:

$$0.9 \times H < H3 \leq H \text{ and } D2 < 1.2 \times L$$

The first row of the lowest platform(s) considered at the level of a spectator's eye, and the last row of the highest platform(s) considered at the level of a spectator's eye are situated facing the screen between its bottom and top edges.

The middle row of the seating zone situated at the height ½ H3 faces the center O of the screen.

The projection apparatus is situated facing the central point of the screen, and no platform is located facing the central point of the screen.

The front edge closest to the screen of each platform occupied by seats, with the exception of the lowest platform(s) is at a distance from the screen that is greater than the distance of the front edges closest to the screen of lower platforms.

The distance of the front edge of each platform having seats, with the exception of the lowest platform(s), is such that said front edge is not situated on the viewing axis starting from the eye of a spectator in the last row of the platform situated immediately below and looking at the top edge of the screen.

The platforms are arranged in a staggered configuration along the back wall.

Each platform presents a front edge that is circular and in that the number of rows in each platform lies in the range 2 to 4.

In section in a horizontal plane, the back wall is in the shape of a circular arc with curvature opposite to that of the screen.

A second aspect of the invention relates more generally to a theater, the theater having at least one screen at a front end; display apparatus suitable for displaying visual content on said at least one screen; and a back wall arranged facing said at least one screen. The display apparatus may in particular be apparatus for projecting visual content, e.g. movie projection apparatus.

This second aspect of the invention seeks to define a theater of reduced ground area, but that, in spite of this small ground area constraint, gives spectators (or at least some of them) a certain feeling of privacy, while enabling them to enjoy the show at the same time as a large number of other spectators, thereby experiencing the collective emotions that the show might arouse.

This object is achieved by the fact that the theater further comprises a plurality of platforms, such that each of said platforms has a plurality of seats fastened thereon, and each of said platforms is a projecting platform, presenting a width that is less than 70% of the width of the theater.

The term "projecting platform" is used to designate a platform that, at least for spectators present on the platform, appears to be connected to the remainder of the theater only from behind the seats (and preferably is indeed physically connected to the remainder of the theater only from behind the seats), e.g. via a gangway, and access passage, etc.

By means of this characteristic, the projecting platform is thus at a distance from all of the rest of the theater (with the exception of its parts behind the platform). This enables spectators present on the platform to feel somewhat isolated from the remainder of the theater, and thus to benefit from a certain feeling of privacy.

As a result, for a projecting platform, it is not possible to go from one platform to another platform without going via the back of the platform, behind the seats.

In particular, one or more platforms may be configured in such a manner that the platform can be accessed only by going behind the back wall or along it.

The width of a platform designates its largest dimension in the transverse direction of the theater, i.e. the horizontal direction perpendicular to the front-to-rear direction of the theater.

The platforms may be of relatively small width, e.g. less than 40% or even less than 25% of the width of the theater. This arrangement makes it possible to have platforms that are small, thereby enhancing a feeling of privacy and safety on a platform.

Furthermore, platforms of small width may be arranged side by side, either at the same height, or else slightly offset in height.

Thus, in an embodiment, at least at a first height, and preferably also at least at a second height that is offset from the first height by at least the height of one storey, there are at least two platforms in a given horizontal section plane.

Preferably, the seats are rigidly fastened to the various platforms.

Each platform is arranged in such a manner as to give the people occupying it a certain degree of privacy.

Preferably, for each of the various platforms, the theater is arranged in such a manner that no seat gives a downward view from behind of the spectators occupying the platform in question; in other words, none of the seats in the theater is arranged behind the seats of the platform between the back wall and the platform and in a position that gives a forward view of the platform.

In an embodiment, at least one of the platforms is a suspended platform. The term "suspended platform" is used herein to mean a platform beneath which there is an open space (having the same area as the platform) through which there passes no stand or support for the platform.

This naturally puts certain constraints on the supports of the suspended platform.

In particular, a suspended platform may be held in place solely by its anchoring, i.e. its support, with and in the back wall. No prop element (in particular no supporting post or column) is then arranged under the platform standing on the floor of the theater or on another platform or supported by the side walls (left or right wall) of the theater.

Thus, in an embodiment, at least one suspended platform is supported solely by the back wall and/or through the back wall (or in equivalent manner, said at least one suspended platform is supported by a support that rests on or bears against only the back wall and/or through the back wall. Herein, the term "support of the platform" covers exhaustively all of the elements (beams, concrete slabs, etc.) that provide the platform with mechanical support). The platform under consideration then does not bear against the sides of the theater.

Advantageously, since mechanical support for the platform is provided solely by the back wall of the theater, the building constraints that result from the presence of the platform apply only to the back wall. This design opens up certain possibilities for the arrangement of the theater. In particular, the mechanical qualities of the walls constituting the side walls of the theater no longer need to be taken into account when designing the theater (at least in terms of supporting the suspended platform(s)).

This makes it possible in particular to make theaters in simple manner, e.g. by renovating an existing theater, by constructing a back wall having one or more suspended platforms supported thereby, but without structural intervention on the side walls of the theater.

Preferably, since the platform does not have any support on its sides, it can also be arranged at a distance from the side walls of the theater (left wall and right wall). This type of support thus makes it easier to create projecting platforms.

That said, as an alternative, in an embodiment, the support for a platform could bear against the sides of the theater.

For example, a platform may be connected to a gallery arranged behind the platform (relative to the screen(s)), the gallery itself bearing on one or more side walls of the theater.

The theater of the invention usually presents smaller depth (in the direction perpendicular to the screen) than a conventional theater since the spectators are distributed over a certain number of platforms that are generally superposed, at least in part. Advantage can be taken of this small depth as follows: the back wall is placed in the rear portion of an existing theater with passages giving access to the various platforms being located behind the back wall.

Furthermore, the back wall may optionally have a function in supporting the ceiling (and in particular the roof) of the theater. It need not have this function of supporting the roof, and above all it may have the function of supporting the platforms, and also of supporting elements giving access to the various platforms (stairs, floors, gangways, etc.). By way of example, in an embodiment, the back wall does not extend up to the ceiling of the theater.

Preferably, the theater does not have only one platform, but rather has several. It then has one or more other suspended platforms presenting the same characteristics as the above-described platform.

Furthermore, in known manner, other seats may naturally be provided on the floor of the theater.

The platform(s) may present one or more of the following arrangements. (These arrangements are described below with reference to one platform, however they could optionally apply to a plurality of platforms, and possibly to all of them.)

Shape and Position of the Platforms

As mentioned above, each of the platforms projects, and is thus arranged within a common theater volume between the screen and the back wall.

Furthermore, there is preferably no separation (not even a sheet of glass, for example) between the space of the platform and the remainder of the inside volume of the theater.

By means of this provision, a spectator sitting on one of the seats of a platform benefits from a certain feeling of privacy and does not have the feeling of mixing with the mass of other spectators present in the theater. As a result, when the mass of spectators feel a particular emotion in the presence of a show, each of the spectators sitting on the platform may likewise feel that emotion and thus participate in collective emotion.

Furthermore, each of the platforms may be arranged either against the back wall, being integral therewith, or else at a distance from the back wall. This second provision serves to increase a feeling of privacy for spectators on that platform.

In particular, in an embodiment, the seats of one or more platforms are arranged at a distance from the back wall, and in particular at at least three row depths from the back wall (where a "row depth" is the distance between two seats forming part of two adjacent rows of seats, measured in the front to back direction of the theater).

Furthermore, seen from above, the shape of each platform may be selected quite freely. For example, a platform may be in the shape of a disk (a circular shape).

In an embodiment, a rear portion of at least one of said platforms has a width less than a maximum width of the platform. The rear portion of the platform may in particular present a width that is less than 80% of the maximum width of the platform. (Consideration is given here only to those portions of the platform that allow spectators to move.)

This arrangement makes it possible to provide a passageway of flared shape, or at least of width that is intermediate between the access(es) to the platform and the seats, thereby enhancing fluid movement of spectators between the platform under consideration and the remainder of the theater.

Access to the Platforms

Access to a platform is preferably provided via the rear of the platform.

In an embodiment, for said platform or for at least one of said platforms, the theater is arranged in such a manner that access to at least one of the platforms can take place only via one or more passageways formed through the back wall.

This provision minimizes as much as possible any disturbance to the show caused by spectators moving during the show.

In another embodiment, for at least one of the platforms, the theater is arranged in such a manner that access to the platform under consideration can take place only via one or more galleries running along the back wall. This provision minimizes as much as possible any disturbance to the show caused by spectators moving during the show.

In an embodiment, for at least one of said platforms, at least one access gangway gives access to the platform, in particular from the back wall. The theater may be arranged in particular in such a manner that access to the platform under consideration can take place only via said at least one gangway.

Crossing such a gangway gives spectators accessing the platform the impression of changing places, of accessing a specific space. This feeling may be enhanced by other arrangements (specific floor coverings, etc.).

In order to enhance this feeling, in an embodiment, for at least one of the platforms, said at least one gangway extends over an accumulated width (obtained by summing the widths of a plurality of gangways if there is more than one) that is less than half (preferably less than one-third) of the total width of the platform under consideration.

Platform Supports

The platforms may be supported in various ways.

In an embodiment, at least one of the platforms is essentially supported by one or more arms connecting the back wall to the platform. For example, when seen from above, the support of a platform may appear to be a single arm connecting the back wall to the platform.

The term "essentially supported" means that more than 90% of the weight of the platform under consideration is supported by the arm(s) connecting the back wall to the platform.

In an embodiment, the support has at least one beam passing through the back wall and resting thereon. The support element(s) of the platform may bear against the back wall, but they may also be fastened to elements situated on the other side of the back wall.

Thus, in an embodiment, at least one of the platforms is supported by at least one beam passing through the back wall and bearing thereon, said beam supporting a counterweight disposed on the side of the back wall that faces away from the screen. This counterweight serves to balance at least in part the twisting moment that is applied by the platform to the back wall.

The counterweight may also provide an access path to the platform. It may thus in particular comprise at least a portion of a floor.

Advantageously, in addition to their access function, the above-mentioned access gangway(s) may also have a function of supporting the platform. Thus, in an embodiment, at least one of the platforms may be supported solely by said at least one gangway.

Relative Positioning of the Platforms

In the theater of the invention, the positions of the various platforms may be optimized so as to give spectators more sensations during a show.

Thus, in an embodiment, the platforms that are higher up are situated further away from the screen.

This provision gives the spectators occupying the various platforms (apart from the platforms of the last storey) a viewing angle that is larger and less obstructed upwards, and thus a greater feeling of freedom.

This result may be achieved by arranging the back wall so that its front surface (considered as a whole) slopes backwards. Thus, a point of the front surface of the back wall is further away from the screen when it is situated at a higher position on the back wall. This configuration serves to increase the inside volume of the theater in its top portion, thereby giving an impression of space that spectators generally appreciate.

Alternatively, or in addition, it is also possible to make provision for the platforms to be situated closer to the back wall when they are situated higher up.

Under such circumstances in particular, but not only under such circumstances, provision may be made for the back wall to be vertical, thereby naturally enhancing its ability.

Furthermore, the feeling of privacy perceived by the viewers on a platform may be enhanced by arranging the various platforms at specifically chosen different heights.

Preferably, the platforms may thus be arranged at different levels, distributed over the entire height of the screen. The theater then normally has paths giving access to the platforms, which serve to define a plurality of storeys.

Under such circumstances, in an embodiment, among the platforms, at least a first platform and a second platform are arranged horizontally at substantially the same level, with the difference in height between the first and second platforms being less than 70% of the height of a storey.

In this embodiment, at a level under consideration, the theater thus presents at least two platforms situated at the same level or at neighboring levels. This provision makes it possible to increase the spectator-receiving spaces, i.e. the platforms, while conserving a theater of relatively small volume.

In order to increase the feeling of privacy within the platforms, the first and second platforms may preferably be arranged in such a manner that there is an offset in height between these two platforms (e.g. an offset greater than 20% or indeed greater than 40% of the height of a storey).

In particular, for a platform that is surrounded by other platforms, when the theater is seen in face view (i.e. from the screen), it is preferable for the platform to be arranged in a staggered configuration relative to the four other platforms that are nearest thereto. This provision serves to maximize the feeling of separation relative to the other platforms, while occupying a minimum volume.

BRIEF DESCRIPTION OF THE DRAWINGS

Other characteristics and advantages of the invention appear clearly from the following description given by way of non-limiting indication and with reference to the accompanying figures, in which.

DETAILED DESCRIPTION OF THE DISCLOSURE

Figure 1:
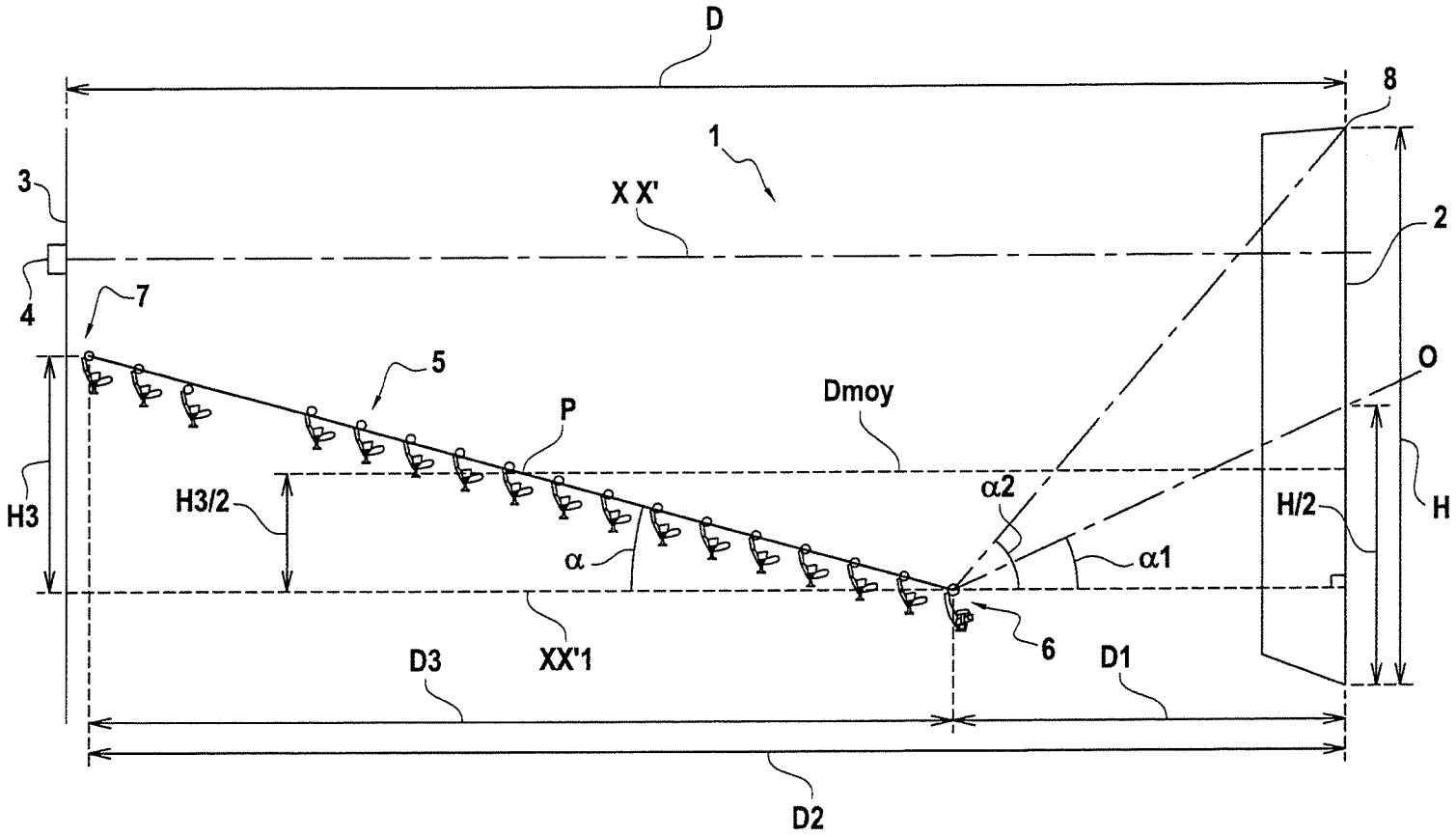
FIG. 1, described above, is a section end view of an existing IMAX-Pathe Disney Village theater.

With reference to FIGS. 1 to 10, there follows a description of a theater 10 constituting a first embodiment of the invention.

This theater 10 has a screen 14 at a front end; a movie projection apparatus 22 (e.g. such as display apparatus suitable for displaying visual content on a screen), and a back wall 15, arranged facing the screen 14. The back wall 15 has various platforms 17 projecting therefrom and arranged to receive spectators. For this purpose, each of the platforms has seats fastened thereon. These various platforms are suspended platforms, i.e. they are platforms supported solely by and/or via the back wall, as described below, in particular with reference to FIG. 9.

Figure 2:
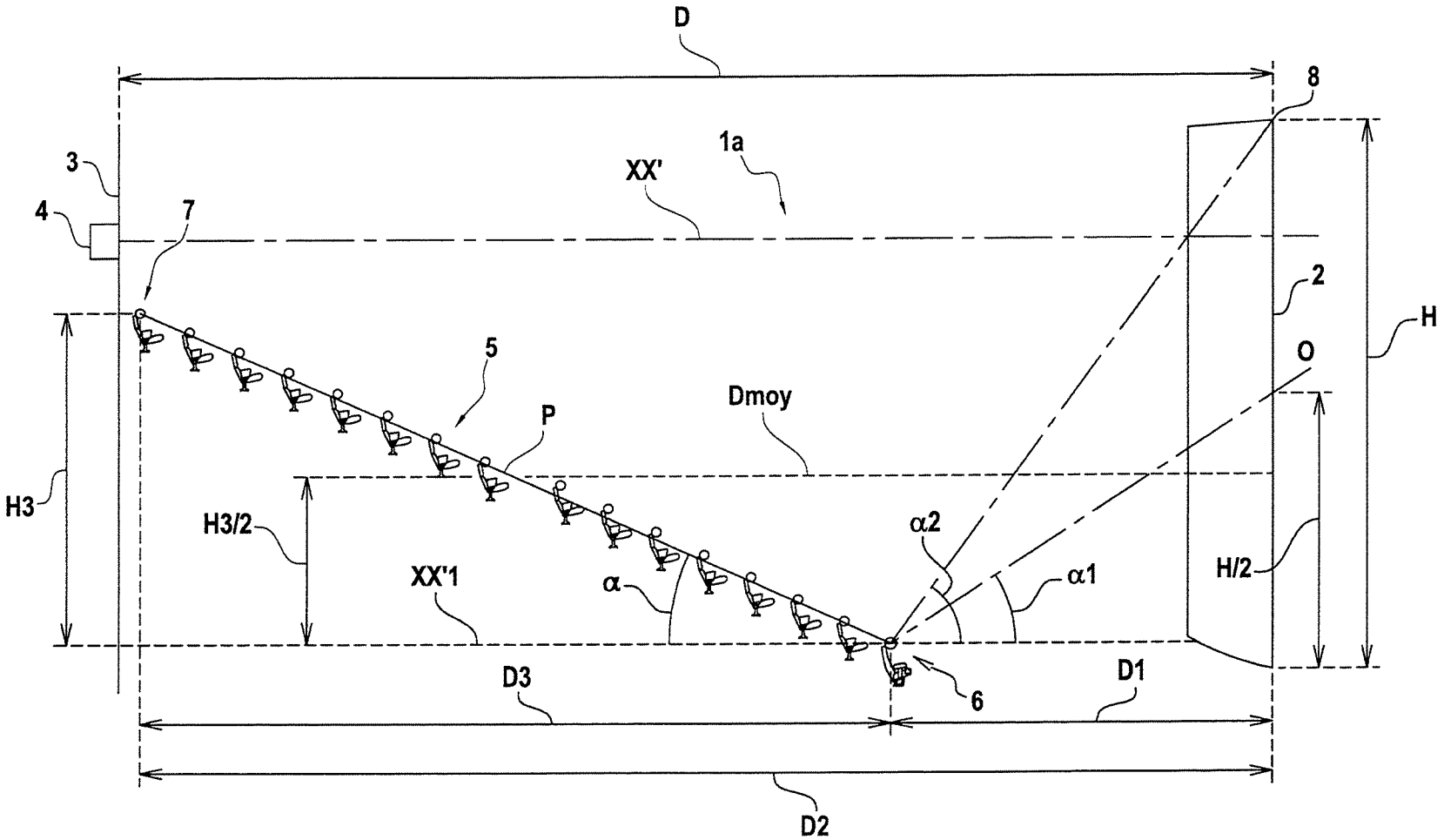
FIG. 2, described above, is a section end view of an existing IMAX-Pathe-La Valette du Var theater.

The movie theater presents a seating zone of original configuration. Specifically, the suspended platforms secured to the back wall form a configuration for the seating zone in which the first row(s) are further away from the screen, and conversely the last row(s) are closer to the screen than in a traditional theater configuration as shown in FIG. 1 or 2 (in other words, the depth of the seating zone is reduced) Within each platform, the slope of the tiers complies with the standards in force.

Furthermore, the platforms may be distributed over all or most of the height of the projected image, thereby making it possible to increase the number of seats and to arrange the spectators facing the entire surface of the image.

Furthermore, the movie projection apparatus (housed in the present example in a projection booth) may be positioned exactly on the geometrical axis of the center of the screen 15.

These arrangements make it possible to provide a better compromise for situating spectators facing the projection screen.

As mentioned above, certain recommendations of the CST refer to the dimensions (width L, height H) of the largest projected image. In order to give a concrete nature to the characteristics of the invention, in the description below, it is considered that the dimensions L, H of the largest projected image correspond to the dimensions L, H of the screen. Naturally, it should be understood that the screen in question presents dimensions that match the format of the projected image.

If not, then it is the dimensions L, H of the largest projected image that should be taken into consideration.

Figure 3:
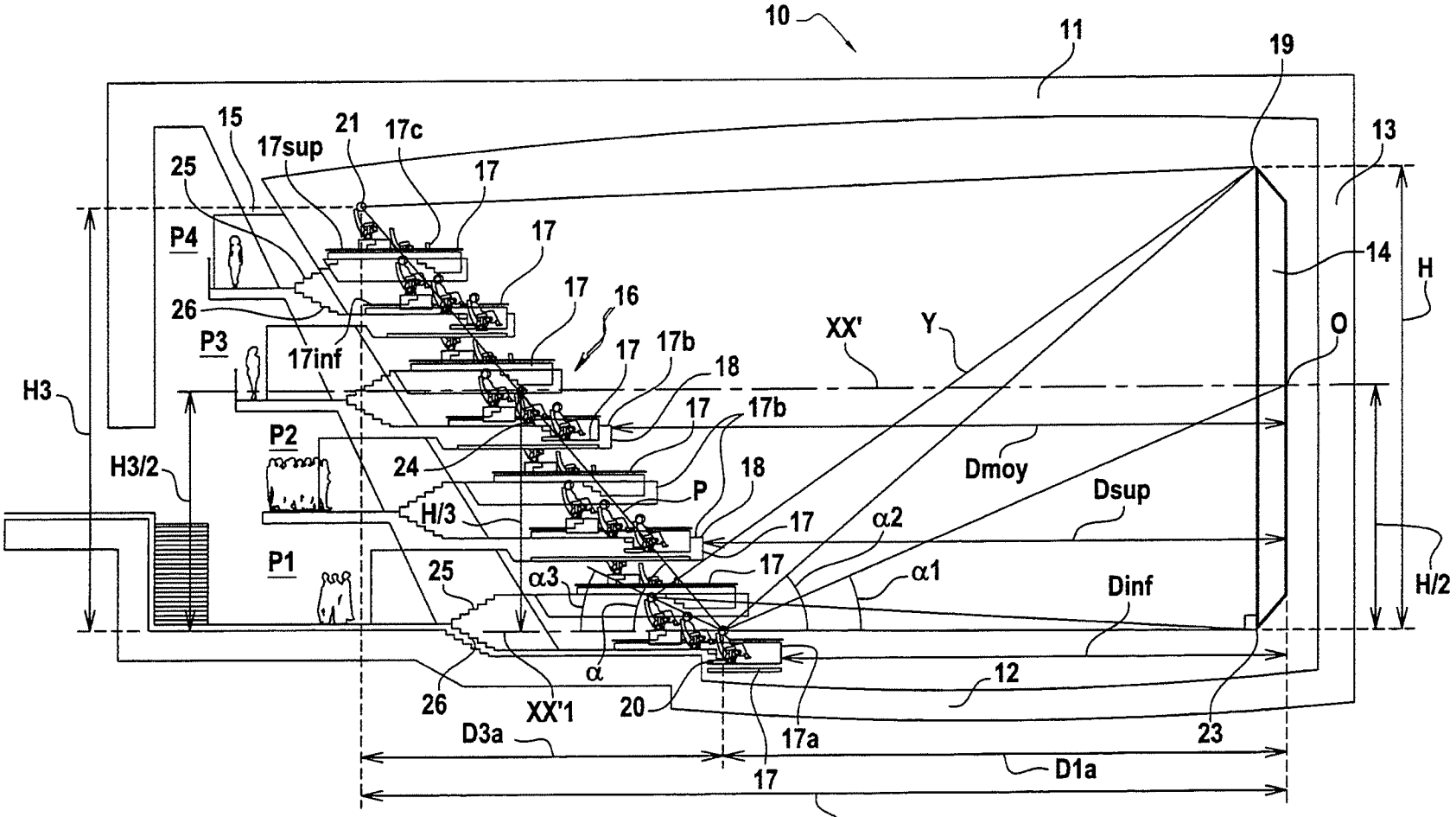
FIG. 3 is a diagrammatic longitudinal sectional view of a theater of the invention in a first variant on a vertical section plane III-Ill of FIG. 5 that is offset from the projection axis XX'.

With reference to FIG. 3, the volume of the theater 10 is defined by a ceiling II, a floor 12, a front wall 13, having the screen 14 placed in front of it, and a back wall 15. The screen 14 presents a concave circular shape of the kind already known in certain present-day theaters. In this example, it is considered that the width L of the screen is 29 m and its height H is 15.30 m, it being understood that the ratio UH is usually defined as follows:

$$1.66<L/H<2.39$$

Figure 4:
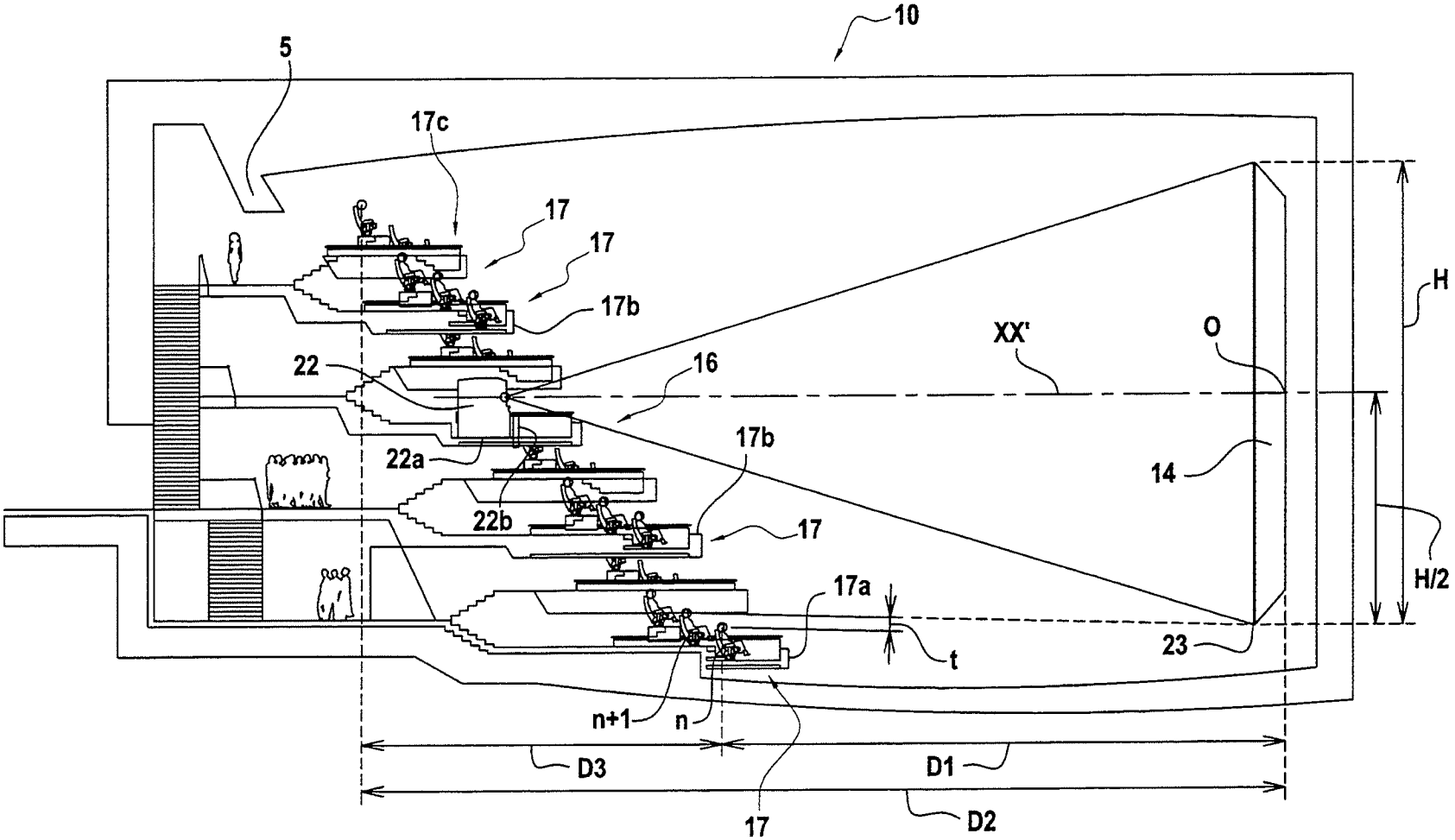
FIG. 4 is a diagrammatic longitudinal sectional view on the plane of the projection axis XX' of the theater of the invention in a first variant (vertical section plane IV-IV of FIG. 5)

With reference to FIGS. 3 and 4, the seating zone 16 has a plurality of platforms 17. With the exception of the platforms 17*a* at the bottom level, all of the platforms are suspended, and they are thus secured to the back wall 15. The term "suspended" should be understood as meaning that the platforms are held in place solely by being anchored with and in the back wall 15 and that no supporting column or post is provided that would interfere with visibility for spectators on lower platforms. The platforms 17 are arranged as lowest platforms 17*a*, as intermediate platforms 17*b*, and as highest platforms 17*c*, along the full height H of the screen 14.

In the theater 10, the platforms 17 are situated further away from the screen 14 when they are arranged at a greater height. Consequently, the lowest platforms 17*a* are the closest to the screen 14, and the high platforms 17*c* are the furthest away. Apart from the lowest platforms, each platform 17 is thus situated further away from the screen than the platforms that are lower than the platform under consideration (with the exception of the platform that supports the projection booth, as explained below). As a result, and as shown in FIG. 3, the front edge 18 closest to the screen 14 of each platform 17 is situated at a distance Dsup from the screen 14 that is greater than the distance Dinf of the front edges 18 closest to the screen 14 of the lower platforms.

Figure 5:
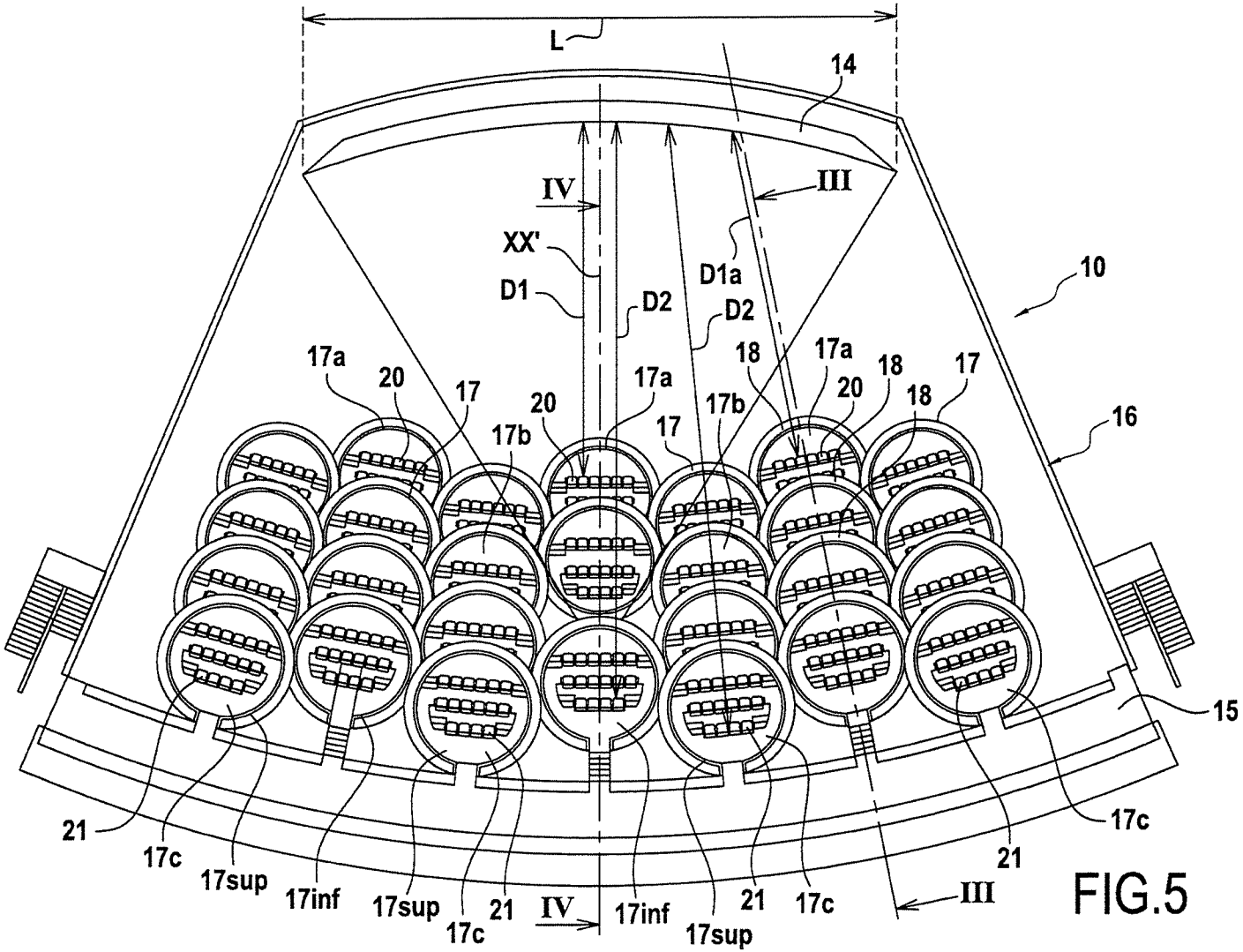
FIG. 5 is a top plan view of the theater of the invention in the first variant.

With reference to FIGS. 3, 4, and 5, and given the concave circular shape of the screen 14 (in section on a horizontal plane) and given the opposite circularly arcuate configuration of the seating zone 16, it should be observed that the distances DI, DIa (FIG. 5) of the first rows 20 differ depending on the lateral position of the lowest platform 17*a*. It should be considered that all of the distances DI, DIa, including the shortest, need to satisfy the criteria that are defined below. The distance D2 of the last rows from the screen 14 is identical in FIGS. 3, 4, and 5 since this distance D2 is taken in the same section plane. In the example shown, three rows of seats are provided for each platform 17. In order to ensure that all spectators, including those in the last rows, can see the entire projected image, the front edge 18 closest to the screen 14 of each platform 17, not including the lowest platforms, is situated at a distance Dsup from the screen that ensures this front edge 18 is not positioned in the viewing cone Y starting from the eye of a spectator situated on the last row of the platform situated immediately beneath and looking at the top edge 19 of the screen 14.

This distribution of spectators in the suspended platforms 17 means that the standards relating to the slope of tiers as applied to rows of seats arranged continuously and served by a continuous stair or aisle do not apply. In the example shown, the angle α defining a projected slope of the tiers from the first row 20 of the lowest platforms 17*a* to the last row 21 of the highest platforms 17*c* is 50°. More precisely, the angle α is considered as being the angle formed between the plane P containing the first row 20 and the last row 21 of the seating zone 16 relative to the axis XX' 1 that is parallel to the projection axis XX' (in the section planes of FIGS. 3 and 4) and perpendicular to the screen 14. The angle α3 defining the slope of the tiers within a platform 17 is itself less than 24°.

This increase in the general slope of the tiers enables the spectators to be spread out over a greater portion or even the entire height H of the screen (of the largest projected image), and also makes it possible to have the first rows 20 further away from the screen 14. In this example, and with reference to FIG. 3, the first distance D1*a* of the first row 20 to the screen is about 17.5 m, i.e. about 0.6×L, thereby complying with the CST recommendations. Thus, the spectators situated at the first row 20 of the lowest platform 17*a* do not need to tilt the head to a large extent in order to see the entire projected image. The above-defined angle al relating to the half-height ½ H of the largest projected image lies in the range 20° to 24°, and the angle α2 relating to the top edge 19 of the image lies in the range 37° to 41°, these two values being substantially smaller than the CST recommendations, thereby demonstrating better viewing comfort from these first rows 20 as compared with present-day theaters. The distance D1 (FIGS. 4 and 5) of the first row 20 of the lowest platform 17*a* situated on the projection axis XX' to the screen is greater than the distance D1*a* shown in FIG. 3, such that this distance D1 is necessarily greater than 17.5 m, thereby likewise complying with the CST recommendations.

Visual comfort is also improved for the last row 21 of the highest platform 17*c*. Specifically, configuring the seating zone as suspended platforms enables the last rows to be closer to the screen 14. In the example shown, the second distance D2 of the last row 21 to the screen 14 is about 29.3 m, i.e. almost 1×L, which is much less than the recommendations of the CST, and also less than the distance D2 in the prior art theaters shown in FIGS. 1 and 2. Naturally, increasing the first distance D1, D1*a* and decreasing the second distance D2 leads to a reduction in the seating depth D3, D3*a*, which is about 11.80 m (for the distance D3*a* shown in FIG. 3) as compared respectively with 22.8 m for the theater of FIGS. 1 and 19.4 m for the theater of FIG. 2.

The reduction in the seating depth that results from increasing the angle a of the seating zone 16 thus enables the first rows to be placed at a greater distance from the screen and on the contrary enables the last rows to be placed at a closer distance to the screen (in other words ensuring that the spectators as a whole are closer to the screen) compared with a theater of conventional design, and this is done while increasing visual comfort and immersion in the image for all of the spectators.

Another characteristic shows the new configuration of the seating zone 16 facing the screen. This is the distance Dmoy between the middle row 24 of the seating zone 16 and the screen 14. In the first variant of the invention as shown in FIG. 3, this distance Dmoy is 0.8×L, while for the theater of FIG. 1, the distance Dmoy is 1.2×L, and for the theater of FIG. 2, this distance Dmoy is 1×L. This distance Dmoy is substantially greater along the projection axis XX', but remains substantially less than that of the theaters in FIGS. 1 and 2.

Concerning the seating height H3, as shown in FIG. 3, the platforms are distributed over the entire height H of the screen 14 (or of the largest projected image), or in other words, in this example, H3=H. This arrangement is made possible by the large angle α of the seating zone 16 and thus by the reduction in the seating depth D3*a*, and also by the possibility of installing the projection apparatus 22 facing the center O of the screen 14 between the platforms 17. Unlike a present theater, the height of the last row is no longer constrained by the location for the projection booth.

In addition, in the theater of the invention, the visual headroom between spectators enables each spectator, regardless of position in the theater, to view the entire screen. Visual headroom is determined as follows (with reference to FIG. 4): construct a line going from the eye of the spectator seated in row n+1 to the bottom edge 23 of the screen 14. Construct the vertical line to the line of sight of the spectator of row n. Measure the vertical distance between the point of intersection between these two lines and the level of the eye of the spectator of row n, thereby obtaining the visual headroom t, also referred to as the head separation value, which value is greater than or equal to 12 centimeters (cm).

Figure 6:
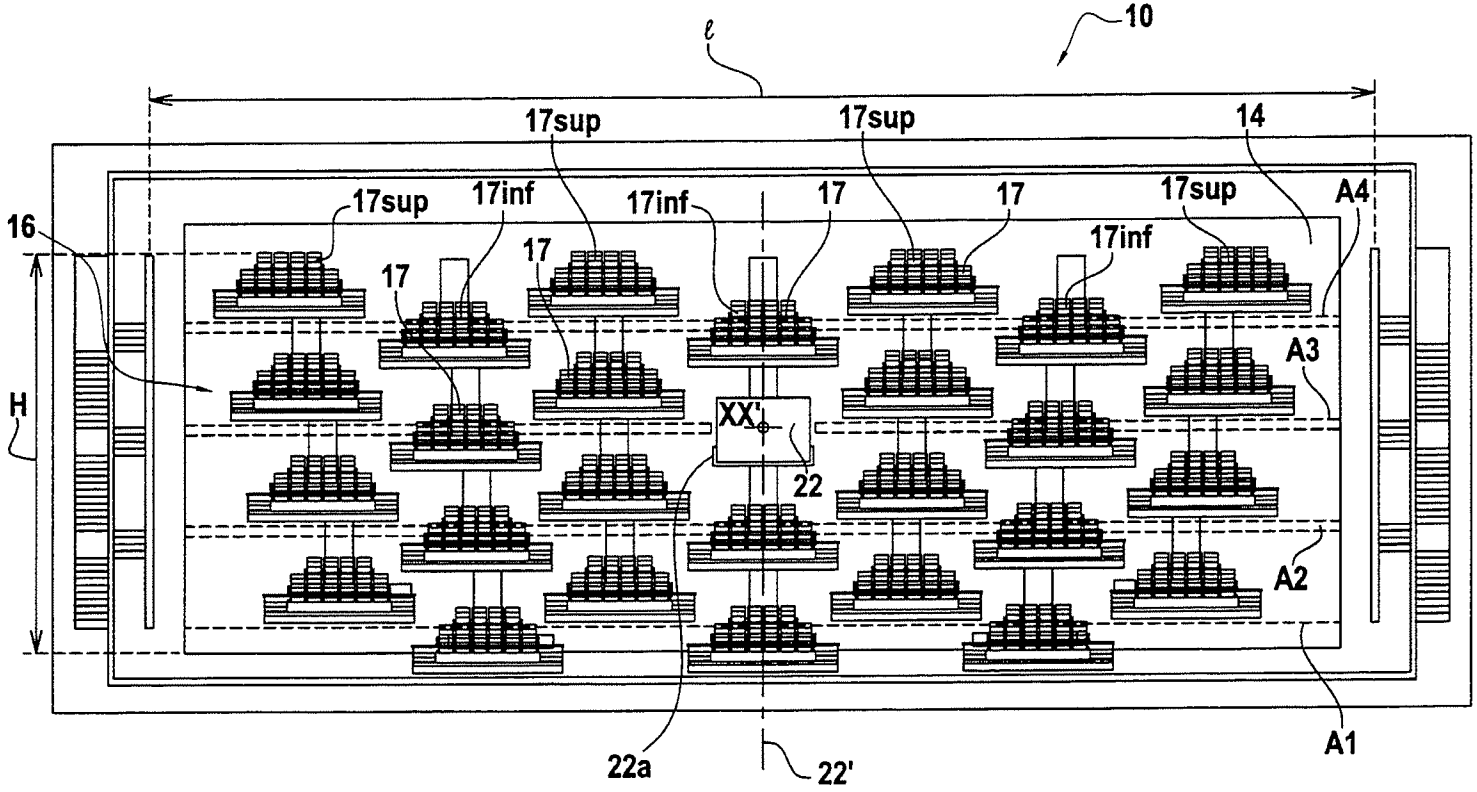
FIG. 6 is a diagrammatic front extended view of the suspended platforms of the theater of the invention in its first variant arranged in a staggered configuration against the back wall.

Reference is made to FIGS. 4 and 6. The projection apparatus 22 is installed exactly on the geometrical axis of the center O of the screen 14 (or of the largest projected image) on a dedicated projection platform 22*a*. This platform 22*a* presents a front edge 22*b* that is set back relative to the platform situated above it, thereby forming an exception to the above-described general principle for arranging the platforms. Thus, both the vertical geometrical distortion and the horizontal geometrical distortion are close to 0°, or indeed are zero, thereby giving best quality to the projected image. It is thus possible to spread the spectators out over the entire height of the image, while benefiting from excellent image quality.

Alternatively, the spectators may be spread out over a portion only of the height H, preferably centered on the center O of the screen 14, i.e. the middle row 24 of the seating zone 16 situated at the height ½ H3 is situated facing the center O of the screen or of the largest projected image.

In order to ensure visual comfort for spectators in the first and last rows 20 and 21, the lowest platform(s) 17*a* is/are installed in such a manner that the eye of the spectator in the first row 20 faces the screen, or in the limit faces the bottom edge 23 of the screen. Similarly, the eye of the spectator in the last row 21 faces the screen, or in the limit faces the top edge 19 of the screen. In other words, all of the platforms 17 are installed facing the screen, and thus the largest projected image, including facing its top and bottom edges, and furthermore all of the platforms 17 are centered heightwise on either side of the center O of the screen. The seating zone 16 thus enables all spectators to be immersed in the image from the first row to the last row.

With reference to FIG. 6, the platforms 17 are arranged in a staggered configuration on the back wall 15 over the entire width L of the screen 14 (not shown in the figure) and over the entire height H of the screen 14. The small offset apparent in the staggered configuration as can be seen in FIG. 6 results from the circularly arcuate configuration of the seating zone 16. This staggered configuration makes it possible to arrange the platforms 17 uniformly, while ensuring sufficient height between two upper and lower platforms along a vertical axis ZZ' to ensure, as explained above, that the front edge 18 of the upper platform does not lie on the line of sight Y starting from the eye of the spectator situated on the last row of the lower platform and looking at the top edge of the screen.

Figure 7:
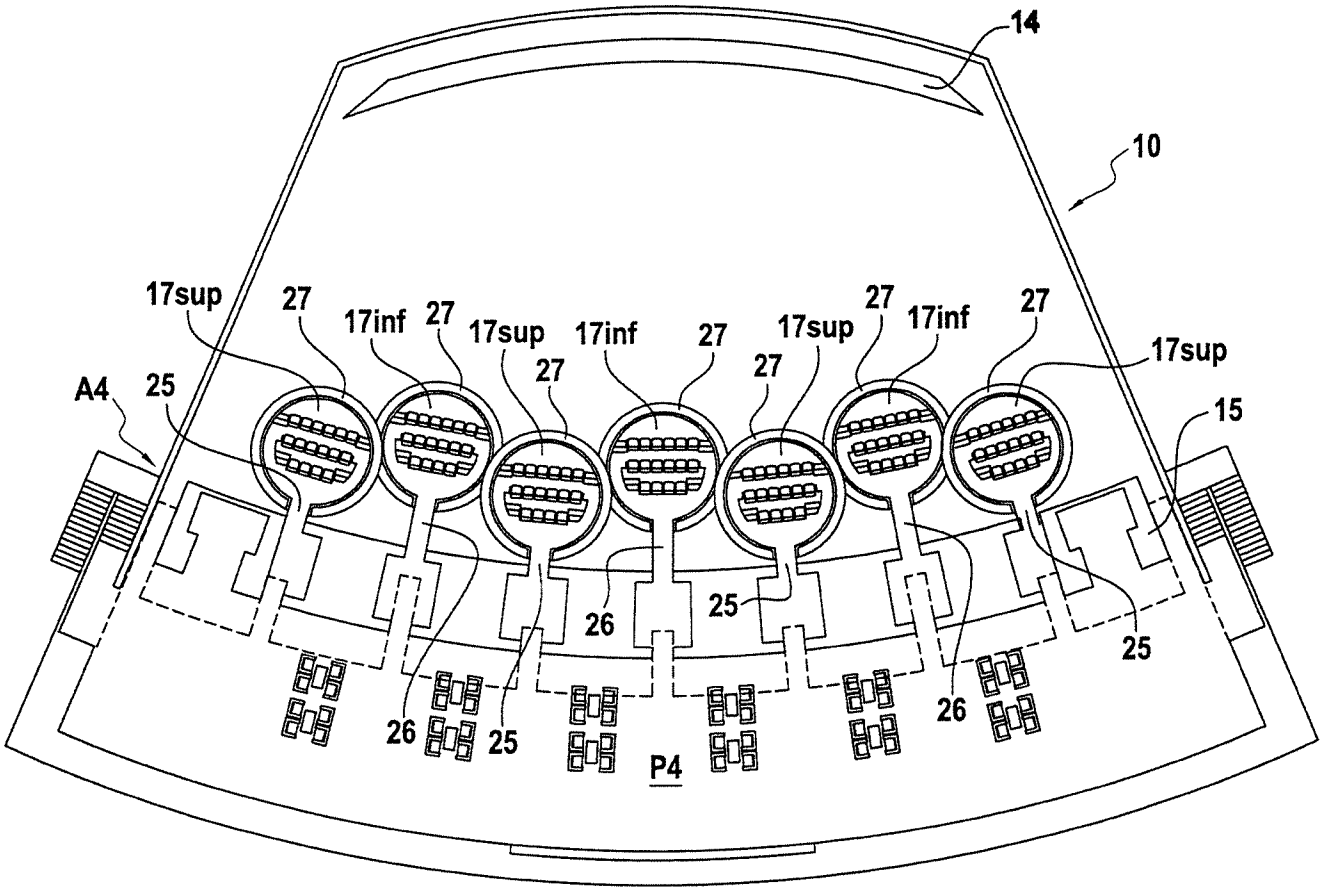
FIG. 7 is a top plan view of a storey of the theater of the invention in its first variant with a series of alternating high and low platforms being served from a common landing.

The platforms are installed on four storeys A1, A2, A3, and A4 that correspond, as can be seen in FIGS. 6 and 7, to four levels of landings P1, P2, P3, and P4 situated outside the theater 10 behind the back wall 15. The landings PI to P4 are accessible via passageways arranged through the back wall 15 and that provide access paths to the platforms.

Each landing level P1, P2, P3, P4 serves upper platforms 17*sup* via a rising stair 25 and lower platforms 17*inf* via descending stairs 26. The landings may be arranged to make the spectators of these platforms 17*sup*, 17*inf* wait. This arrangement may differ depending on the landing, so that personalized services can be proposed depending on the positions of spectators in the theater.

The platforms 17*inf* and 17*sup* served by a given storey are arranged horizontally at substantially the same level. They are not at exactly the same level, but on the contrary they are offset in the height direction ZZ' by about half a storey. This offset enables the various platforms to be perceived by the spectators occupying them as spaces that are clearly distinct, thereby contributing to giving a feeling of privacy to the spectators.

Furthermore, the small width of the platforms 17 (less than 15% of the width of the theater) makes it possible at a given height to have a plurality of platforms side by side.

Thus, at a first height, which is the height of the storey A1, and in a horizontal plane situated at the level of the higher platforms 17*sup*, there are four platforms 17*sup*.

Furthermore, in each of the horizontal planes arranged respectively one, two, and three storeys above the horizontal plane situated at a first height, there are likewise four platforms 17*sup*.

The platforms 17*inf* are offset by half a storey relative to the platforms 17*sup*. Each of the horizontal section planes at the levels of the platforms 17*inf* pass through only three platforms 17*inf*, given the staggered arrangement of the platforms. These section planes are offset from the planes intersecting the platforms 17*sup* by about half a storey.

Figure 8:
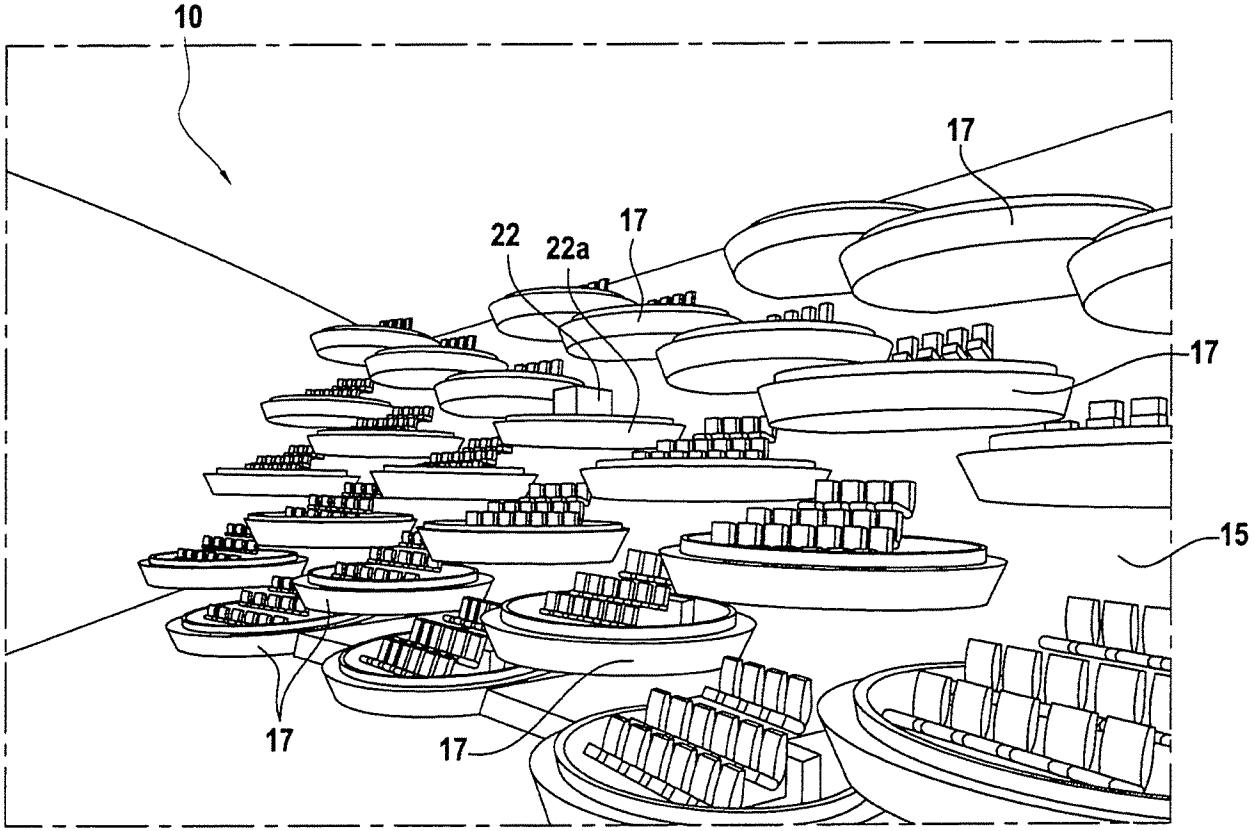
FIG. 8 is a diagrammatic perspective view of the suspended platforms of the movie theater of the invention in its first variant with its platforms against the circularly arcuate back wall.

In this example, and as shown in FIGS. 7 and 8, each platform presents an edge 27 that is circular and has three rows of seats. The spectators installed on a platform 17 thus have a sensation of privacy while benefiting from the convivial nature of a present-day movie theater.

The back wall 15 is preferably circularly arcuate of curvature opposite to that of the concave circular shape of the screen 14 (not visible in FIG. 7), thereby improving convergence of spectator lines of sight towards the center of the image.

Figure 9:
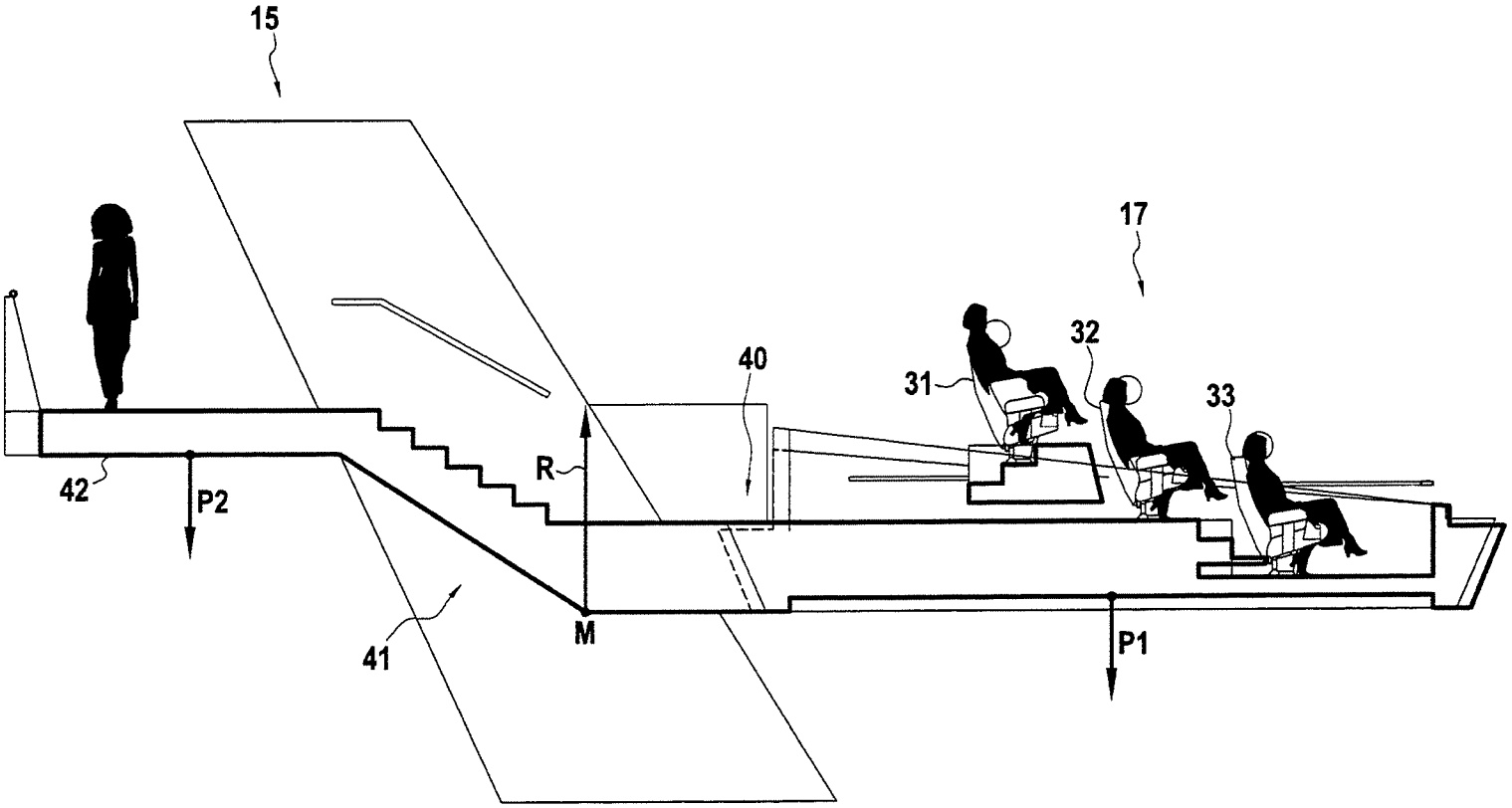
FIG. 9 is a diagrammatic longitudinal sectional view of a platform of the theater in its first variant.

FIG. 9 is a longitudinal section through one of the platforms 17. As can be seen, the platform 17 shown in a suspended platform, the space under the platform 17 being open without any support for the platform.

The platform 17 has three rows of seats 31, 32, and 33 situated one behind another in the direction going from the center of the platform to the center of the screen. These three rows of seats are also offset in height: the row 31 is placed a little higher than the row 32, which is itself placed a little higher than the row 33, so as to give an unobstructed view of the screen from each of the seats on the platform 17. In general manner, the number of rows on a platform may vary; typically there may be two to six rows and preferably there are three to five rows.

Figure 10:
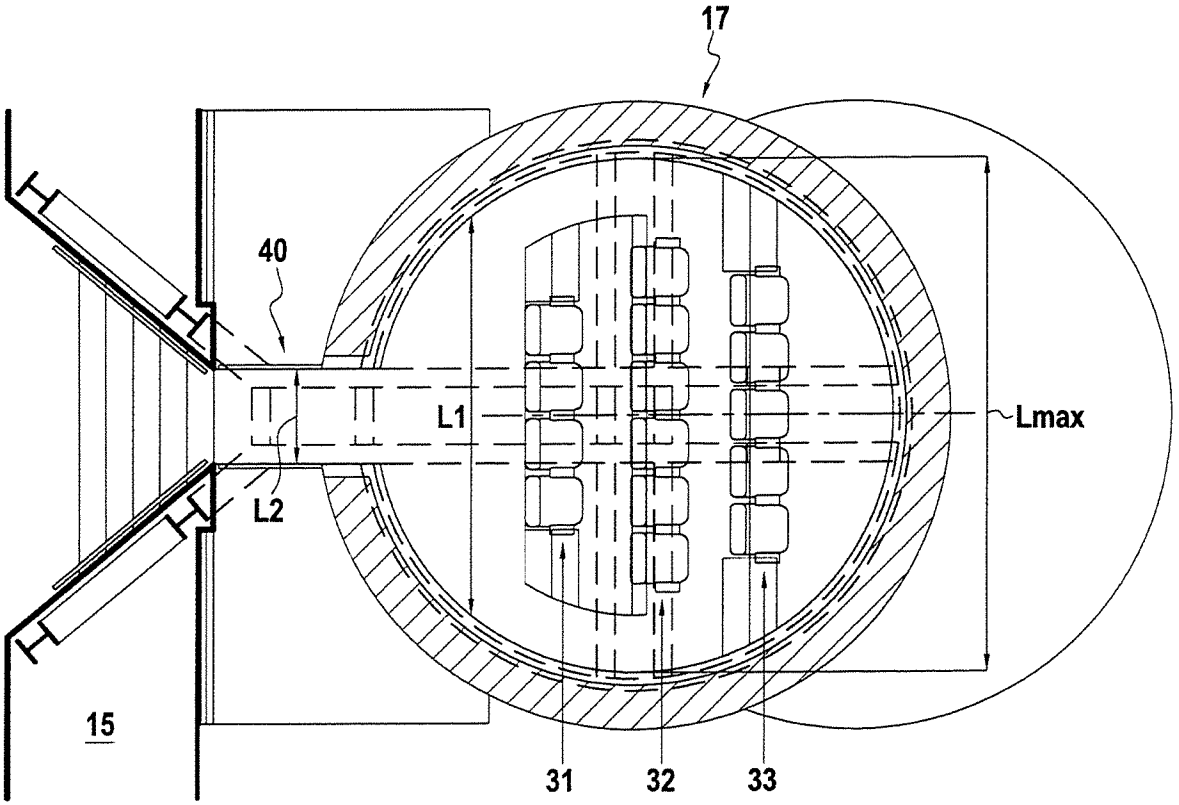
FIG. 10 is a top plan view of the platform shown in FIG. 9.

The platform 17 is shown in plan view in FIG. 10.

The platform 17 is arranged at a distance from the back wall 15. It is also connected to the back wall 15 by an access gangway 40. The platform 17 is thus accessed by passing through a passageway arranged in the back wall 15 and then along the gangway 40.

This passageway thus provides an access path to the platform 17.

The gangway 40 is part of a beam 41 that extends through the back wall 15, bearing thereon in a bearing zone about a point M (shown diagrammatically in FIG. 9) and rigidly connected to a floor 42 situated behind the back wall 15. (The term "beam" is used herein broadly to designate a rigid body presenting a degree of elongation in one direction.)

The weight P2 of the floor 42 generates a moment at the pint M of sign that is opposite to the moment generated by the weight PI of the platform 17. The floor 42 thus acts as a counterweight relative to the platform 17; it therefore serves to reduce the bending moment imposed on the wall thereby. Conversely, the back wall 15 supports the combined weight of the platform 17 and of the floor 42 (reaction force R applied to the beam 41, FIG. 10).

The gangway 40 thus constitutes not only means for accessing the platform 17, but also the support for the platform. Seen from above, the support of the platform (the gangway 40) appears as a single arm connecting the back wall to the platform.

The gangway 40 extends over only a width L2 that is quite small compared with the total width Lmax of the platform 17 (FIG. 10). Typically, this width L2 is less than half, or indeed less than one-fourth of the maximum width Lmax of the platform.

More particularly, likewise when seen from above, the rear portion of the platform has a width L1 that is less than the maximum weight Lmax of the platform. This arrangement enables a flared passageway to be arranged between the access gangway 40 and the central portion of the platform.

In the embodiment shown, the platform 17 is substantially circular in shape (in a variant it could be elliptical in shape)

Each of these arrangements (narrow width of the gangway (s) between the platform and the back wall, narrow width of the rear portion of the platform) contributes to giving to the spectators occupying the platform a feeling of privacy while minimizing the amount of material used and thus the weight of the platform.

In the variant shown, a single access gangway 40 gives access to the platform 17 from the back wall 15.

The theater is arranged in such a manner that said platform can be accessed only via this gangway 40. A second variant theater 10 of the invention is shown in FIGS. 11 and 12.

In this variant, as in the above-described variant, the theater 10 has various platforms referred to collectively as the "platforms 117", with these platforms 117 being distributed over a plurality of storeys.

Figure 11:
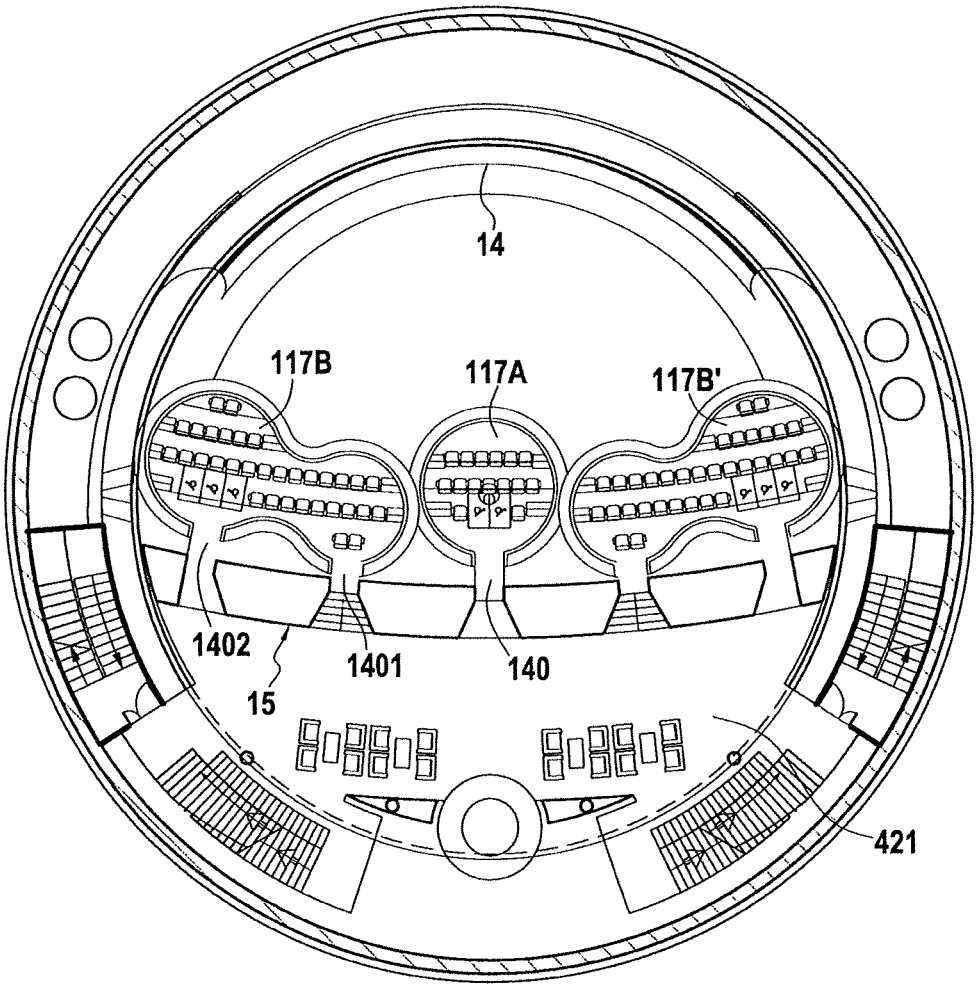
FIG. 11 is a top plan sectional view at a first level showing a theater of the invention, in a second variant.
Figure 12:
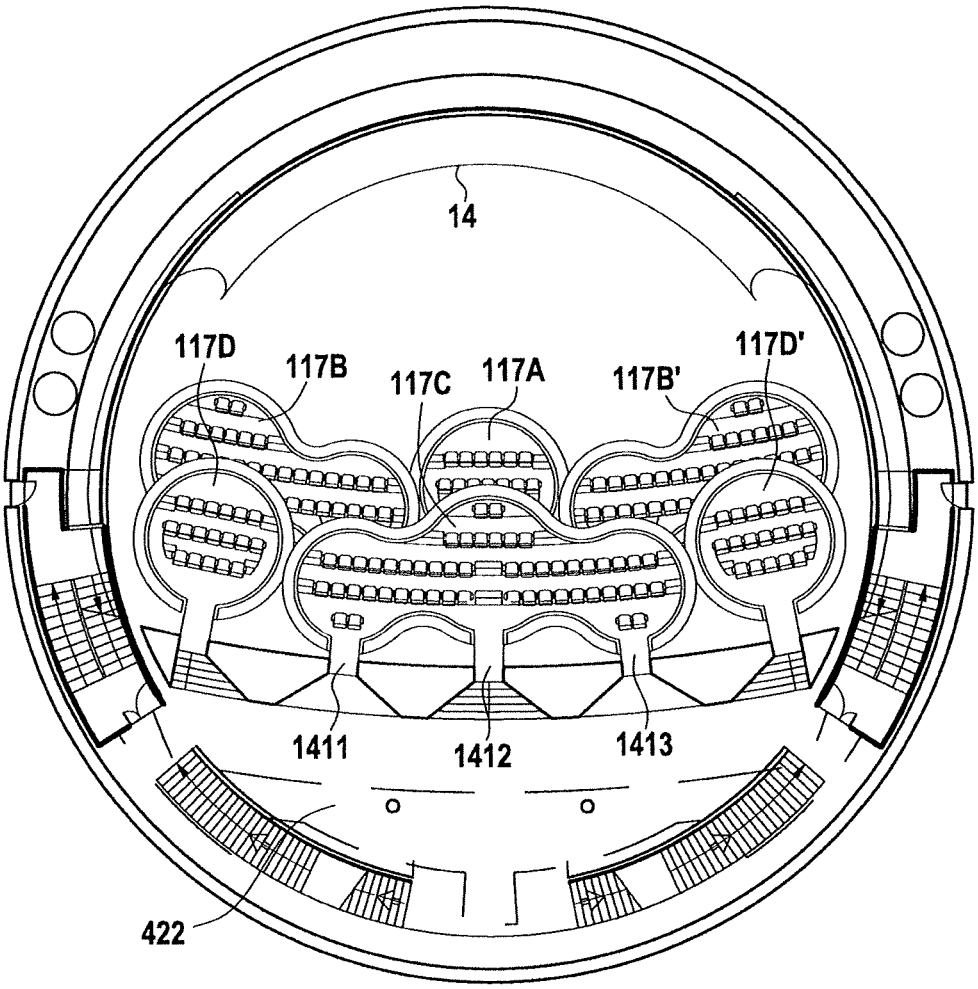
FIG. 12 is a top plan sectional view at a second level that is higher than the first level showing the theater shown in FIG. 11.

FIG. 11 shows those of the platforms 117 that are situated on a first storey: these are the platforms 117 that are accessible from a floor 421 situated at the first storey of the theater 10.

The platform 117A is a circular platform, similar to the platform in FIGS. 9 and 10, and it is served by a single gangway 140.

The platforms 117 of the first storey comprise three platforms 117A, 117B, and 117B'. The platforms 117*b* and 117B' are symmetrical relative to each other about the midplane of the theater. They are situated a little higher than the platform 117A.

The platform 117*b* has four rows of seats. It is arranged at a certain distance from the back wall 15.

It is served by two gangways. These gangways form parts of beams 1401 and 1402 that support the platform 117B. These beams 1401 and 1402 pass through the back wall 15 and they are connected behind it to the floor 421, that they support on its front side, in similar manner to the gangway 40 of FIG. 9.

FIG. 12 shows a second storey of the theater 10 in the second variant. In this storey, the theater 10 has three platforms 117C, 117D, and 117D'. The platforms 117D and 117D' are symmetrical to each other about the midplane of the theater; these platforms are circular platforms similar to the platform of FIGS. 9 and 10. The central platform 117C has five rows of seats. It is accessed from a floor 422 by three gangways. These gangways form portions of beams 1411, 1412, and 1413 that support the platform 117B. These beams 1411, 1412, and 1413 are arranged in similar manner to the gangway 40 of FIG. 9.

Figure 13:
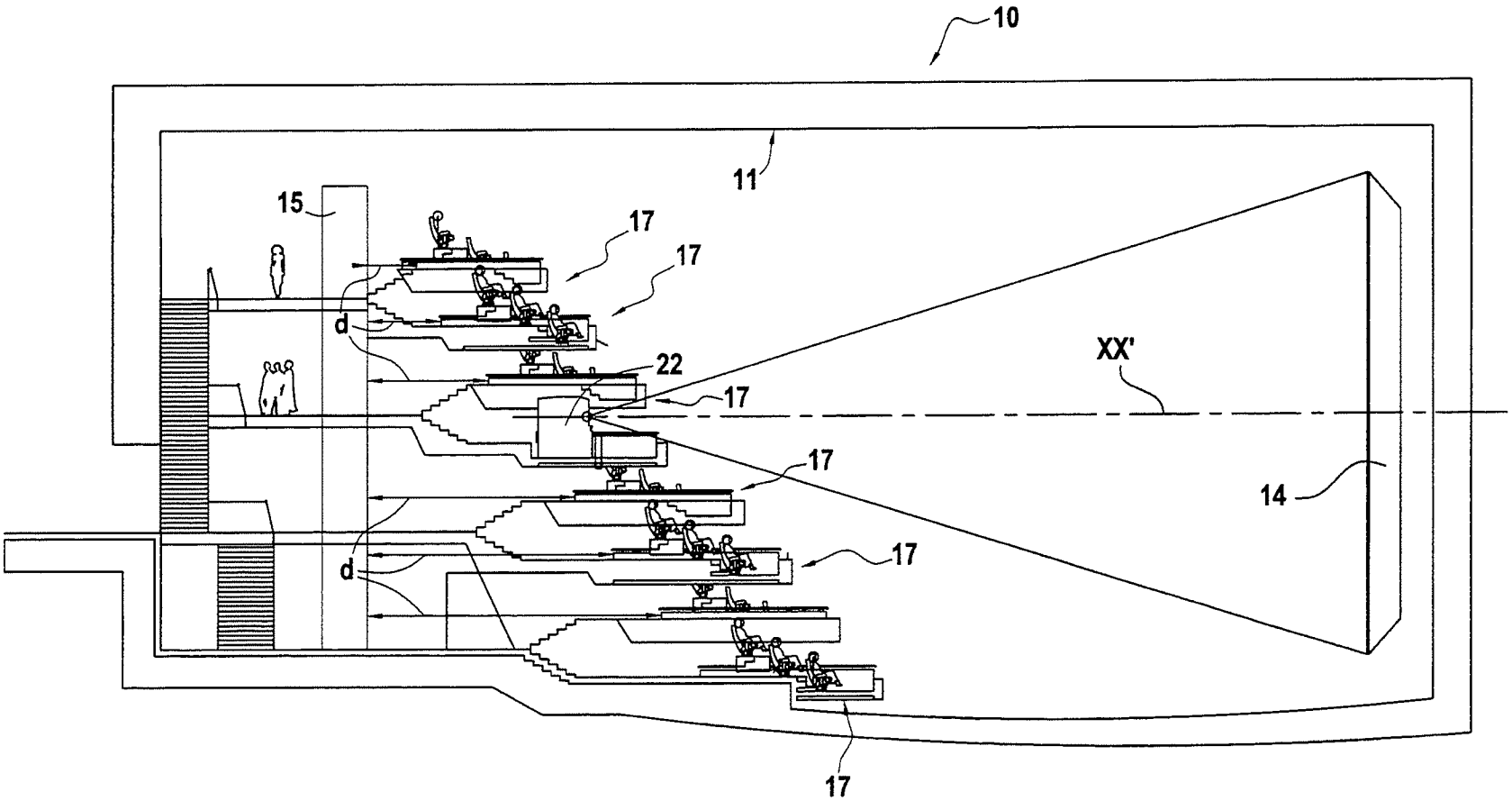
FIG. 13 is a diagrammatic longitudinal sectional view on the plane of the projection axis XX' of a theater of the invention in a third variant.

With reference to FIG. 13, there follows a description of a third variant embodiment.

As mentioned above, the platforms are preferably not all situated at the same distance from the screen in the theater, but on the contrary the platforms are situated progressively further away from the screen the higher up they are situated.

In the theater of the first or second variant, this arrangement results mainly from the fact that the back wall presents a front surface that slopes backwards (FIG. 3). This makes it possible to arrange the platforms at distances from the screen that increase with the platforms that are situated higher up.

In alternative manner, or in addition to the above provision, it is also possible to provide for the platforms to be situated progressively closer to the back wall, for platforms being situated at increasing heights. It can be understood that under such circumstances, the gangways giving access to the platforms are shorter when they are arranged higher up.

One and/or the other of these provisions may be adopted for varying the depth of the platforms relative to the screen.

FIG. 13 thus shows a third variant in which the platforms are situated progressively closer to the back wall when they are situated higher up. This enables the back wall 15 to be vertical, unlike the first and second variants (and in particular, the back wall 15 has a front face that is vertical). The distance d between a platform 17 and the back wall 15 thus decreases with increasing height of the platform under consideration. This leads to providing one or more access gangways for a platform that are increasingly longer for access platforms that are situated at lower height.

As can be seen in FIG. 13, the back wall 15 does not extend up to the ceiling 11. It does not have a load carrying function for supporting the roof, but only for supporting the suspended platforms 17 and the various floors and stairs giving access to them.

Figure 14:
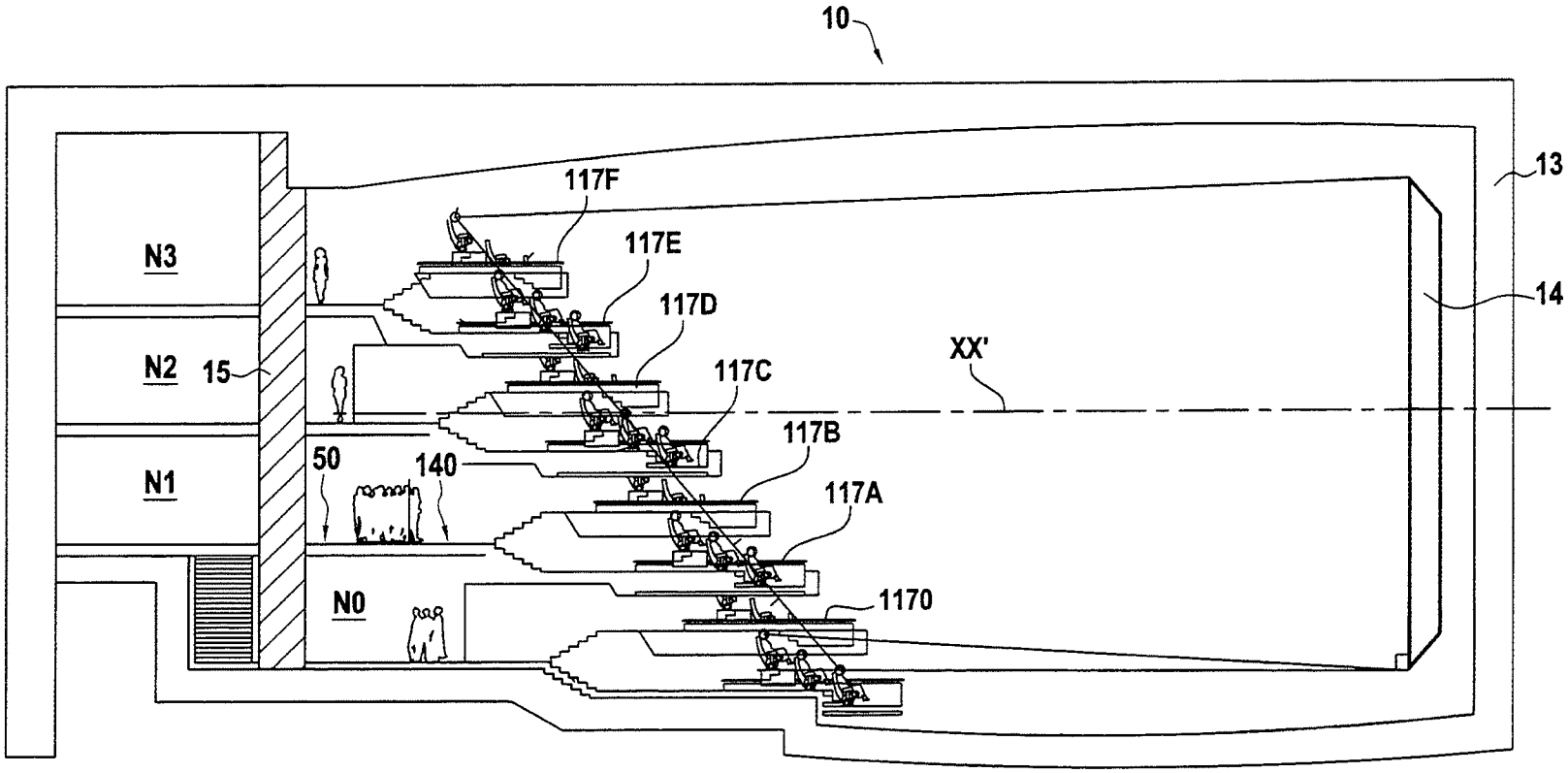
FIG. 14 is a diagrammatic longitudinal sectional view of a theater of the invention in a fourth variant.

A fourth variant embodiment is described below with reference to FIGS. 14 and 15.

The theater in this variant is analogous to the theater in the third variant, and like the previously-described theaters, it presents various projecting platforms that are referred to selectively as the "platforms 117".

Going upwards, these platforms 117 comprise platforms 1170 at the bottom storey NO of the theater (the lowest platforms 1170 not being suspended platforms); platforms 117A and 117B on the first storey N1 of the theater; platforms 117C and 117D on the second storey N2 of the theater; and platforms 117E and 117F on the third storey N3 of the theater.

Figure 15:
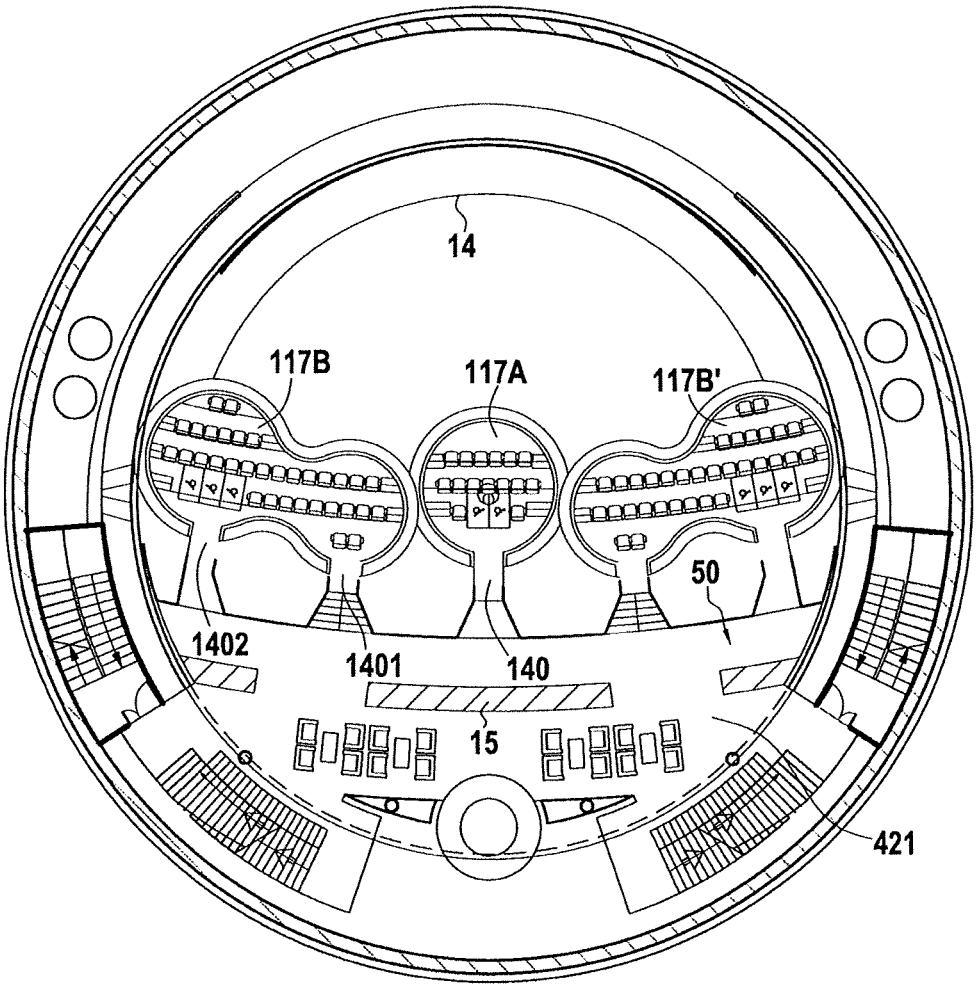
FIG. 15 is a top plan sectional view at a first level showing the theater shown in FIG. 14, in the fourth variant.

FIG. 15 shows the first storey N1 of the theater, seen from above.

A major difference between the second and third variant embodiments and the fourth variant embodiment lies in the way in which the platforms 117 are accessed.

In the second and third variant embodiments, the platforms have access gangways that extend to the back wall 15; a platform is accessed solely by passing through the back wall and moving along one of the gangways.

In contrast, in the fourth variant, instead of accessing the platforms 17 by passageways that pass through the back wall 15 of the theater, these platforms are accessed by walking along a gallery arranged in front of the back wall 15 (e.g. at the first storey N1, the gallery 50, FIG. 15), and then by going along one of the gangways, e.g. one of the gangways 140, 1401, 1402.

Each of the platforms 17 is thus connected to the gallery 50 via one or more gangways: the gangway 140 for the platform 117A, the gangways 1401 and 1402 for the platform 117B. Because of these gangways, the platforms are arranged at a certain distance from the remainder of the 5 theater, in particular at a certain distance from the gallery 50. This makes it possible to provide a degree of privacy for spectators installed on the platforms.

At each storey, the back wall 15 has passageways making it possible to go from the gallery to the landing 10 provided behind the back wall 15. These landings, e.g. the landing 421 on storey N1 (FIG. 15) gives access to stairs and thus gives access to the various storeys.

The invention claimed is:

1. A theater comprising:

a screen at a front end;

a display apparatus suitable for displaying a visual content on said screen;

two side walls;

a back wall arranged facing said screen; and a plurality of platforms such that each of said platforms has a plurality of seats fastened thereon and said plurality of platforms is attached to the back wall, and that each of said platforms:

is a projecting platform, that for spectators present on the platform, is connected to the remainder of the theater only from behind the seats;

presents a width that is less than 70% of the width of the theater; and enables spectators to walk on the platform so as to access seats that are provided on the platform; and wherein one of said platforms is placed substantially in front of a center point of the screen.

2. A theater according to claim 1, wherein at least one of said platforms is a suspended platform, beneath which there is an open space, having the same area as the platform, through which there passes no stand or support for the platform.

3. A theater according to claim 2, wherein at least one suspended platform is supported solely by the back wall and/or through the back wall.

4. A theater according to claim 1, including access paths to said platforms, the access paths defining a plurality of storeys; and among said platforms, at least a first platform and a second platform are arranged horizontally at substantially the same level, with a difference in height between the first and second platforms being less than 70% of the height of a storey.

5. A theater according to claim 1, wherein said at least one platform is arranged at a distance from the back wall.

6. A theater according to claim 1, wherein the rear portion of at least one of said platforms has a width less than a maximum width of the platform.

7. A theater according to claim 1, arranged in such a manner that access to at least one of said platforms can be obtained only via one or more passageways arranged through the back wall.

8. A theater according to claim 1, wherein, for at least one of said platforms, at least one access gangway provides access to the platform.

9. A theater according to claim 1, wherein, for at least one of said platforms, at least one access gangway is accessed to the platform from the back wall.

10. A theater according to claim 8, wherein at least one platform is supported solely by said at least one gangway.

11. A theater according to claim 8, wherein, for at least one of said platforms, said at least one gangway extends over an accumulated width that is less than half a maximum width of the platform.

12. A theater according to claim 1, wherein at least one of the platforms is essentially supported by one or more arms connecting the back wall to the platform.

13. A theater according to claim 1, wherein at least one of the platforms is supported by at least one beam passing through the back wall and bearing thereon, said beam supporting a counterweight disposed on a side of the back wall that faces away from the screen.

14. A theater according to claim 1, wherein the platforms that are higher up are situated further away from the screen.

15. A theater according to claim 1, wherein the back wall presents a front surface that slopes backwards.

16. A theater according to claim 1, wherein, in face view, at least one platform is arranged in a staggered configuration relative to four other platforms that are the closest thereto.

17. A theater according to claim 1, further comprising a ceiling, and wherein the back wall does not extend up to the ceiling.

18. A theater according to claim 1, wherein at least at a first height, there are at least two platforms in a given horizontal section plane.

19. A theater according to claim 1, wherein at least at a first height, and also at least at a second height that is offset from the first height by at least the height of one storey, there are at least two platforms in a given horizontal section plane.

20. A theater comprising:

a screen at a front end;

a display apparatus suitable for displaying a visual content on said screen;

two side walls;

a back wall arranged facing said screen; and a plurality of platforms such that each of said platforms has a plurality of seats fastened thereon, and that each of said platforms:

is a projecting platform, which projects from the back wall and, for spectators present on the platform, is connected to the remainder of the theater only from behind the seats;

presents a width that is less than 70% of the width of the theater; and enables spectators to walk on the platform so as to access seats that are provided on the platform;

and wherein a first platform among said at least one platform is arranged at a distance from the back wall.

21. A theater according to claim 20, wherein the rear portion of the first platform has a width less than a maximum width of the platform.

22. A theater according to claim 20, wherein the first platform is configured in such a manner that the first platform can be accessed only by going behind the back wall or along it.

23. A theater comprising:

a screen at a front end;

a display apparatus suitable for displaying a visual content on said screen;

two side walls;

a back wall arranged facing said screen; and a plurality of platforms such that each of said platforms has a plurality of seats fastened thereon, and that each of said platforms:

is a projecting platform, that for spectators present on the platform, is connected to the remainder of the theater only from behind the seats;

presents a width that is less than 70% of the width of the theater; and enables spectators to walk on the platform so as to access seats that are provided on the platform;

and wherein the platforms are supported solely by the back wall and/or through the back wall, and the platforms that are higher up are situated further away from the screen.

24. A theater comprising:

a screen at a front end;

a display apparatus suitable for displaying a visual content on said screen;

two side walls;

a back wall arranged facing said screen; and a plurality of platforms such that each of said platforms has a plurality of seats fastened thereon, and that each of said platforms:

is a projecting platform that for spectators present on the platform, is connected to the remainder of the theater only from behind the seats;

presents a width that is less than 70% of the width of the theater; and enables spectators to walk on the platform so as to access seats that are provided on the platform;

wherein a first one of the platforms does not bear against side walls of the theater.

25. A theater comprising:

a screen at a front end;

a display apparatus suitable for displaying a visual content on said screen;

two side walls;

a back wall facing said screen; and a plurality of platforms such that each of said platforms has a plurality of seats fastened thereon, and that each of said platforms:

is a projecting platform that for spectators present on the platform is connected to the remainder of the theater only from behind the seats;

presents a width that is less than 70% of the width of the theater; and enables spectators to walk on the platform so as to access seats that are provided on the platform;

wherein at least one of the platforms is supported by at least one beam passing through the back wall and bearing thereon, said beam supporting a counterweight disposed on a side of the back wall that faces away from the screen.

26. A theater according to claim 24, wherein the platforms that are higher up are situated further away from the screen.

* * * * *